US006736676B2

(12) United States Patent
Zhang et al.

(10) Patent No.: US 6,736,676 B2
(45) Date of Patent: May 18, 2004

(54) LOW-PROFILED ELECTRICAL CONNECTOR WITH IMPROVED HOUSING

(75) Inventors: Guohua Zhang, Kunsan (CN); Ziqiang Zhu, Kunsan (CN); Zhonghua Yao, Kunsan (CN); Hongqiang Han, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 32 days.

(21) Appl. No.: 10/315,623

(22) Filed: Dec. 9, 2002

(65) Prior Publication Data

US 2004/0058583 A1 Mar. 25, 2004

(30) Foreign Application Priority Data

Sep. 25, 2002 (TW) ..... 91215145 U

(51) Int. Cl.[7] ..... H01R 13/648

(52) U.S. Cl. ..... 439/607; 439/606; 439/76.1; 439/79; 439/83; 439/541.5; 439/874; 439/630

(58) Field of Search ..... 439/607, 606, 439/76.1, 79, 83, 541.5, 629–632, 874

(56) References Cited

U.S. PATENT DOCUMENTS 5,478,247 A * 12/1995 Chen et al. ..... 439/65
5,931,687 A * 8/1999 McFarlane et al. ..... 439/79
6,109,966 A * 8/2000 Chiou ..... 439/607
6,210,219 B1 * 4/2001 Zhu et al. ..... 439/567
6,402,566 B1 * 6/2002 Middlehurst et al. .... 439/699.1

* cited by examiner

*Primary Examiner*—Truc Nguyen
(74) *Attorney, Agent, or Firm*—Wei Te Chung

(57) ABSTRACT

A DVI connector (1) comprises an insulative housing (10), a digital terminal module (2) and an analogue terminal module (5) inserted into the housing, a grounding shield (7) enclosing the housing. The insulative housing having a base portion, a mating portion extending forwardly from a front face of the base portion, a mounting portion extending rearwardly from a rear face of the base portion, a pair of steps (110) formed at opposite lateral ends of the base portion, a pair of the arms (14) formed at opposite lateral ends of the mounting portion. Top surfaces (143) of the arms and upper surfaces (111) of the steps are located at a same level, all below a top surface of the base portion. The top surface and the upper surface are used for abutting against a bottom face of a PCB when the connector is mounted to the PCB.

13 Claims, 7 Drawing Sheets

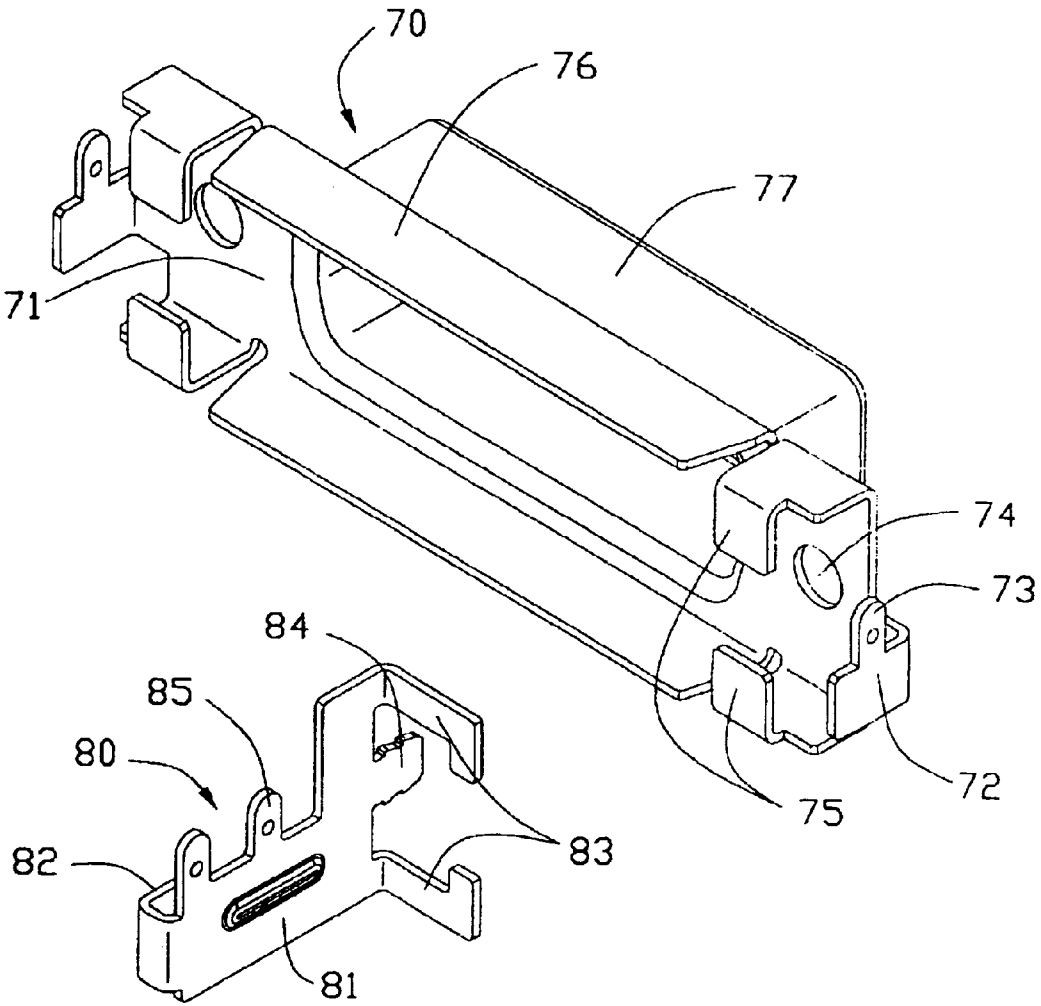
FIG. 5
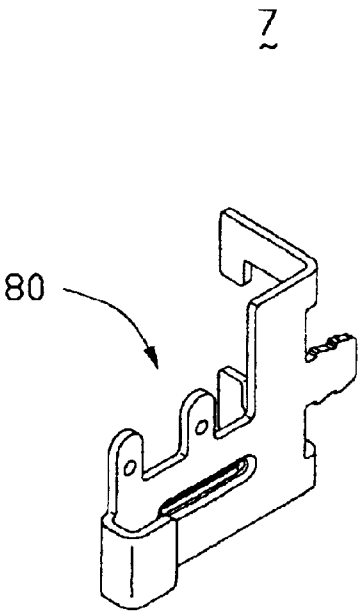
7

LOW-PROFILED ELECTRICAL CONNECTOR WITH IMPROVED HOUSING

BACKGROUND OF THE INVENTION

1. Field of the Invention

The present invention relates to a low-profiled electrical connector, and particularly to a low-profiled electrical connector used in a liquid crystal display (LCD) monitor for connecting the monitor with a computer mainframe, wherein the connector can be stably mounted on an edge of a printed circuit board (PCB).

2. Description of Related Art

With the development of electronics technology, digital interfaces used in LCD was developed as a replacement for analogous interface. Three interface standards, i.e., Plug and Display (P&D), Digital Flat Panel (DFP) and Digital Visual Interface (DVI) are concomitant and DVI will be the promising standard thereof. The DVI standard was developed by Digital Visual Working Group (DDWG) on April 1999. Generally, an electrical connector according the DVI standard comprises a D-shaped insulative housing, a plurality of L-shaped terminals assembled in the insulative housing, a spacer for positioning the terminals and a shield enclosing the housing. The DVI electrical connector is mounted on a surface of a printed circuit board (PCB) for providing a digital and analogous signal transmission.

U.S. Pat. Nos. 6,210,218 B1, 5,692,912 B1, 6,338,652 B1, 5,931,687 B1, and 6,287,146 B1 disclose DVI connectors each of which has an insulative housing having a height totally located above the PCB. Accordingly, these conventional DVI connectors have a high profile above the PCBs, which is unfavorable in view of the thin trend of the electronic devices accommodating these connectors. It is necessary to devise an insulative housing for a DVI connector which when mounted on a printed circuit board has a generally half height thereof above/below the PCB so that a profile of the connector above/below the PCB can be reduced to meet the thin trend of the electronic devices.

SUMMARY OF THE INVENTION

Accordingly, an object of the present invention is to provide an electrical connector having an improved housing whereby the connector can be mounted to a PCB in such manner that generally a half height of the housing is located above/below of the PCB so that the connector have a low profile above/below of the PCB.

Another object of the present invention is to provide a DVI connector having a housing which can be stably mounted to an edge of a PCB in which the DVI connector generally has a half height thereof located above/below the PCB.

In order to achieve the objects set forth, an electrical connector comprises an insulative housing, a grounding shield, and a terminal module. The housing having a base portion, a mating portion extending forwardly from a front face of the base portion, a mounting portion extending rearwardly from a rear face of the base portion. A plurality of passageways is defined in the mating portion. A pair of steps is defined at opposite lateral ends of the base portion. A pair of arms extends upwardly from lateral ends of the mounting portion. A space is defined between the rear face of the base portion and an upper face of the mounting portion for receiving a PCB therein. The arms and the steps have top surfaces for abutting against the PCB, which are located at a level below a top face of the base portion a distance that when the electrical connector is mounted to an edge of the PCB, generally a half height of the connector is located above/below the PCB. Thus, the connector has a reduced profile above/below the PCB. Accordingly, an electronic device accommodating the electrical connector can have a reduced thickness. The grounding shield comprises a plate, a shroud extending from the plate for surrounding the mating portion.

The terminal module has an insulation mounted to the base portion of the housing and a plurality of terminals insert molded with the insulation. The top surfaces of the arms and the steps are located at the same level and abut a bottom face of the PCB when the connector is mounted to the PCB, whereby the connector can be stably mounted to the edge of the PCB.

Other objects, advantages and novel features of the invention will become more apparent from the following detailed description when taken in conjunction with the accompanying drawings.

BRIEF DESCRIPTION OF THE DRAWINGS

FIG. 5 is an enlarged view of a grounding shield and a pair of soldering tabs of the connector of FIG. 2;

DETAILED DESCRIPTION OF THE INVENTION

Figure 1:
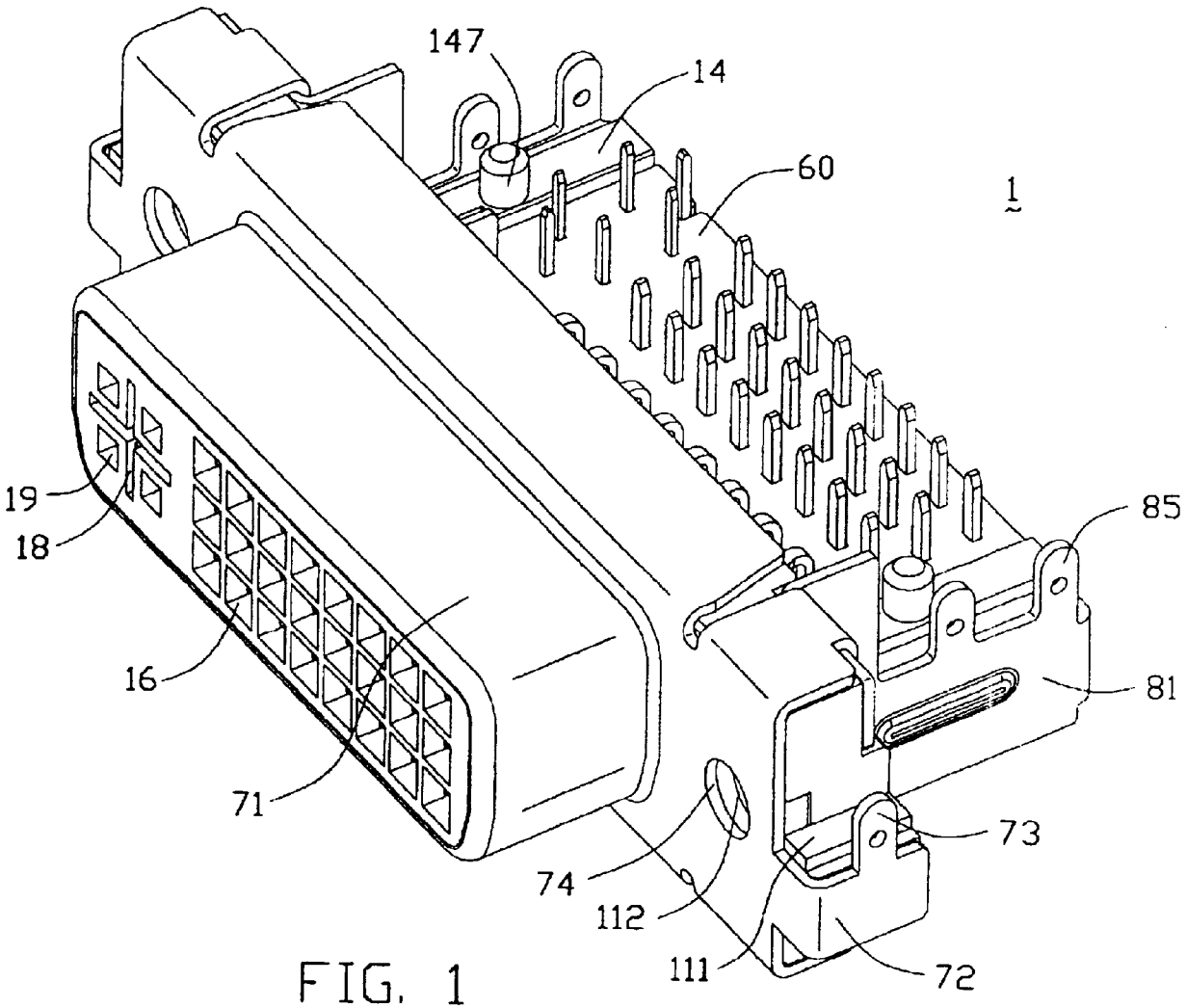
FIG. 1 is an assembled view of a DVI connector in accordance with the present invention.

Referring to the drawings, a low profiled DVI (Digital Visual Interface) connector 1 of the present invention is for mounting to a bottom surface of a printed circuit board (PCB) (not shown). The connector 1 is for mounting in an LCD monitor and mating with a complementary connector of a cable end connector assembly (not shown) connected with a computer mainframe, whereby the monitor and the mainframe can be electrically connected together. The connector 1 comprises an insulative housing 10, a digital terminal module 2, an analogue terminal module 5, a terminal spacer 60, a grounding shield 7, a pair of soldering tabs 80, and a pair of nuts 90.

Figure 2:
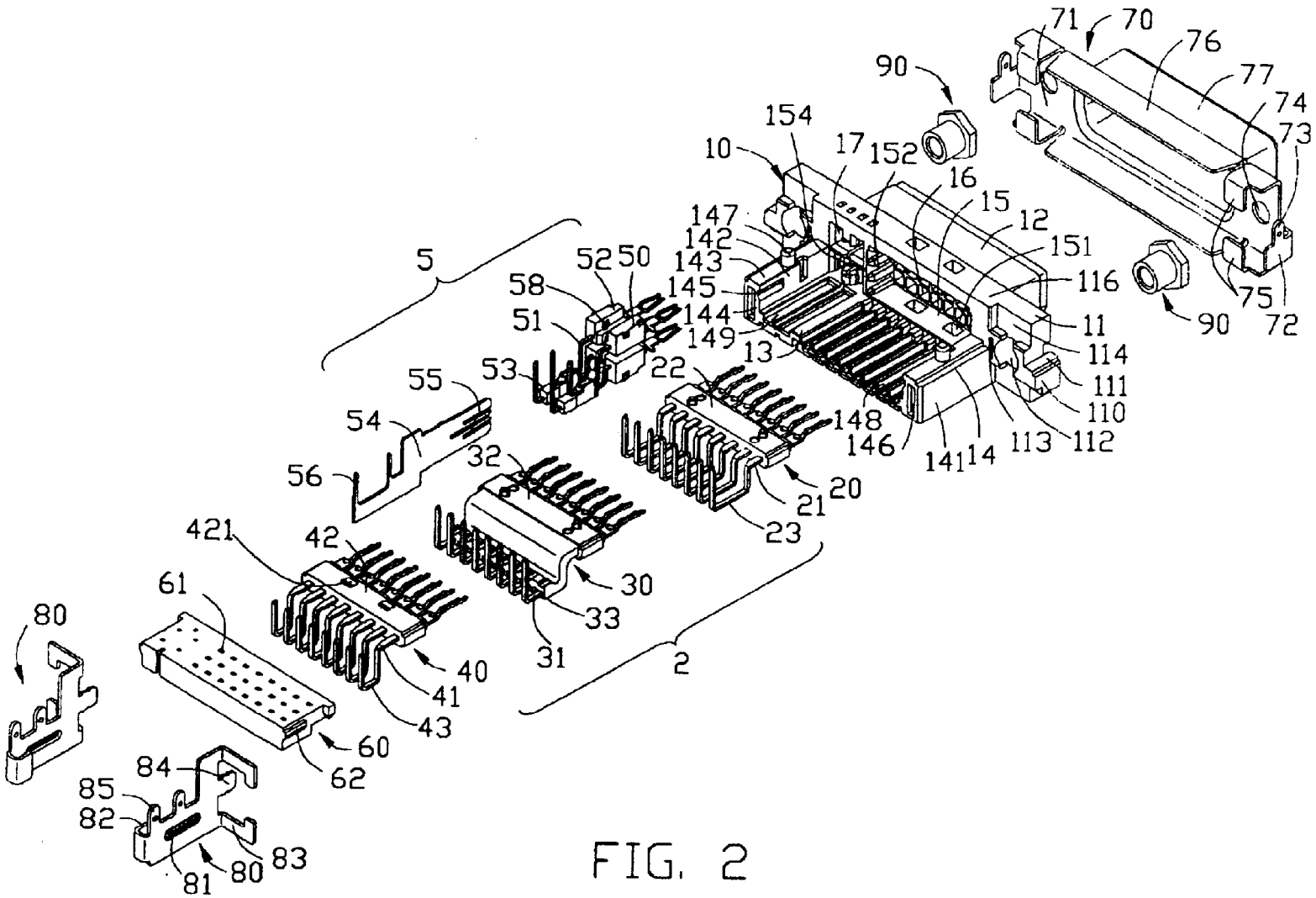
FIG. 2 is an exploded view of the connector of FIG. 1 from a different aspect.
Figure 7:
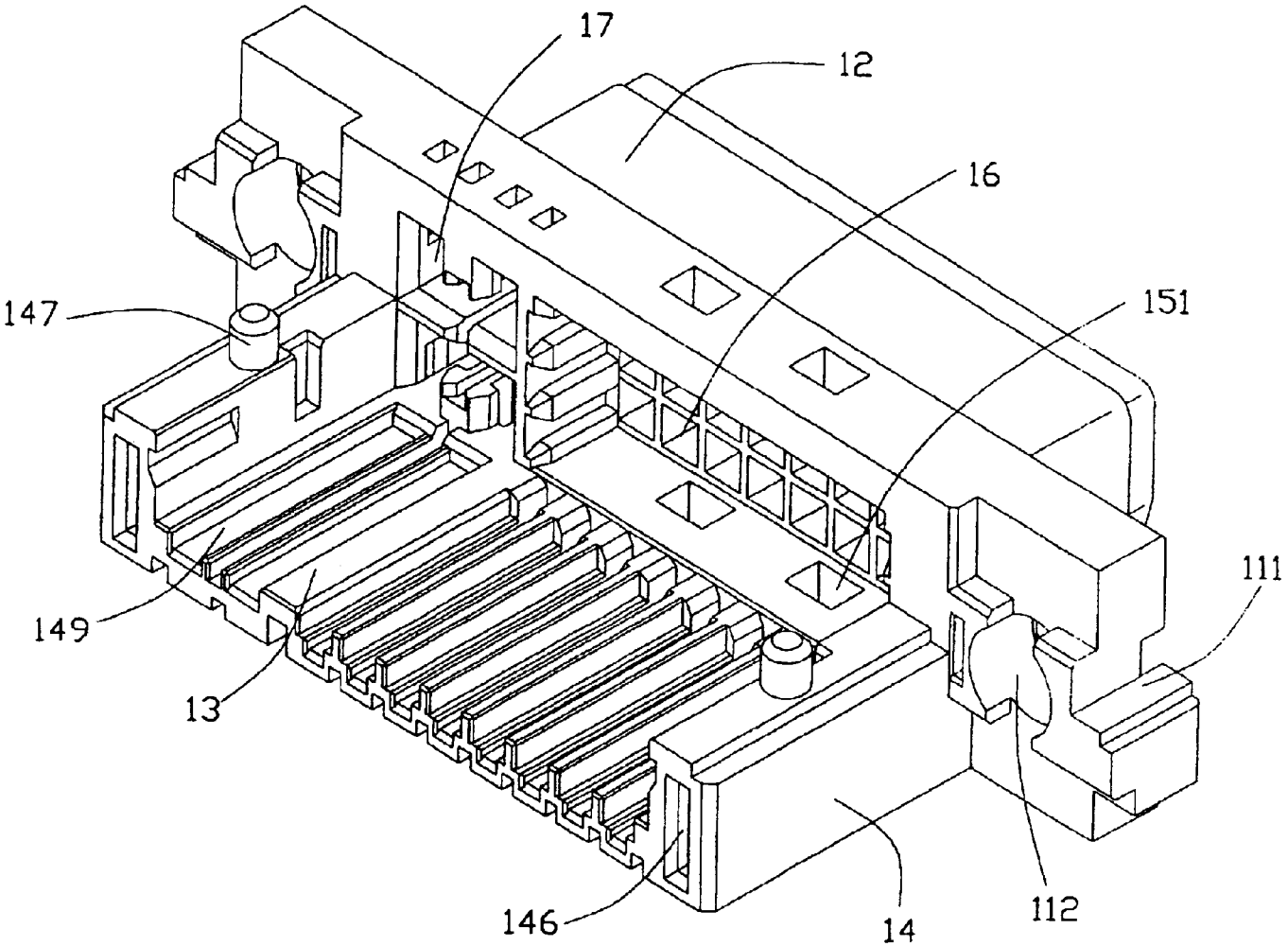
FIG. 7 is an enlarged view of an insulative housing of the connector of FIG. 2.

Particularly referring to FIGS. 1, 2 and 7, the insulative housing 1 comprises an elongate base portion 11, a mating section 12 extending forwardly from the base portion 11, and a rear portion 13 extending rearwardly from the base portion 11. The base portion 11 defines two receiving spaces 15, 17 partitioned by an intermediate wall 154. The intermediate wall 154 defines three grooves 152 communicating with the receiving space 15. A plurality of recesses 151 is defined by the base portion 11 respectively above and below the receiving space 15. The mating portion 12 defines four passageways 19 extending rearwardly through the base portion 11 and communicating with the receiving space 17. The four passageways 19 are separated by a cross silt 18. A pair of channels 113 is defined in a rear face of the base portion 11 adjacent to the rear portion 13. A pair of holes 112 is defined through the base portion 11 and located beside the channels 113, respectively. The holes 112 are located outside the channels 113. The base portion 11 further defines a pair of depressed portions 114 in each of lateral sides of the rear face thereof, respectively above and below corresponding hole 112 and channel 113. The base portion 11 forms a step 110 at each of opposite lateral ends thereof. Each step portion 110 has an upper surface 111 positioned generally at a middle position of a corresponding lateral end of the base portion 11.

The mating portion 12 is generally D-shaped and defines a plurality passageways 16 extending therethrough along a front-to-rear direction. The passageways 16 communicate with the receiving space 15. The cross silt 18 has a shape like a Greek cross, and the passageways 19 are respectively located in four quadrants defined by the cross slit 18. The rear portion 13 has a plate-like tongue portion 131 thereon. A pair of arms 14 extends upwardly from opposite lateral ends of the tongue portion 131. A plurality of grooves 148, 149 is defined in an upper surface of the tongue portion 131. Each arm 14 defines an outer surface 141, an inner surface 142, a top surface 143 and a rear surface 144. The top surfaces 143 of the arms 14 and the upper surfaces 111 of the steps 110 are located at a same level, all below a top surface 116 of the base portion 11 and a top surface 121 of the mating portion 12. Each arm 14 defines a recess 145 in the inner surface 142, extending forwardly from a corresponding rear surface 144. A pair of slots 146 is defined in the rear surface 144. A pair of posts 147 extends upwardly from the top surfaces 143 of the arms 14, respectively, for fitting into the printed circuit board when the connector 1 is mounted to the printed circuit board.

Figure 3:
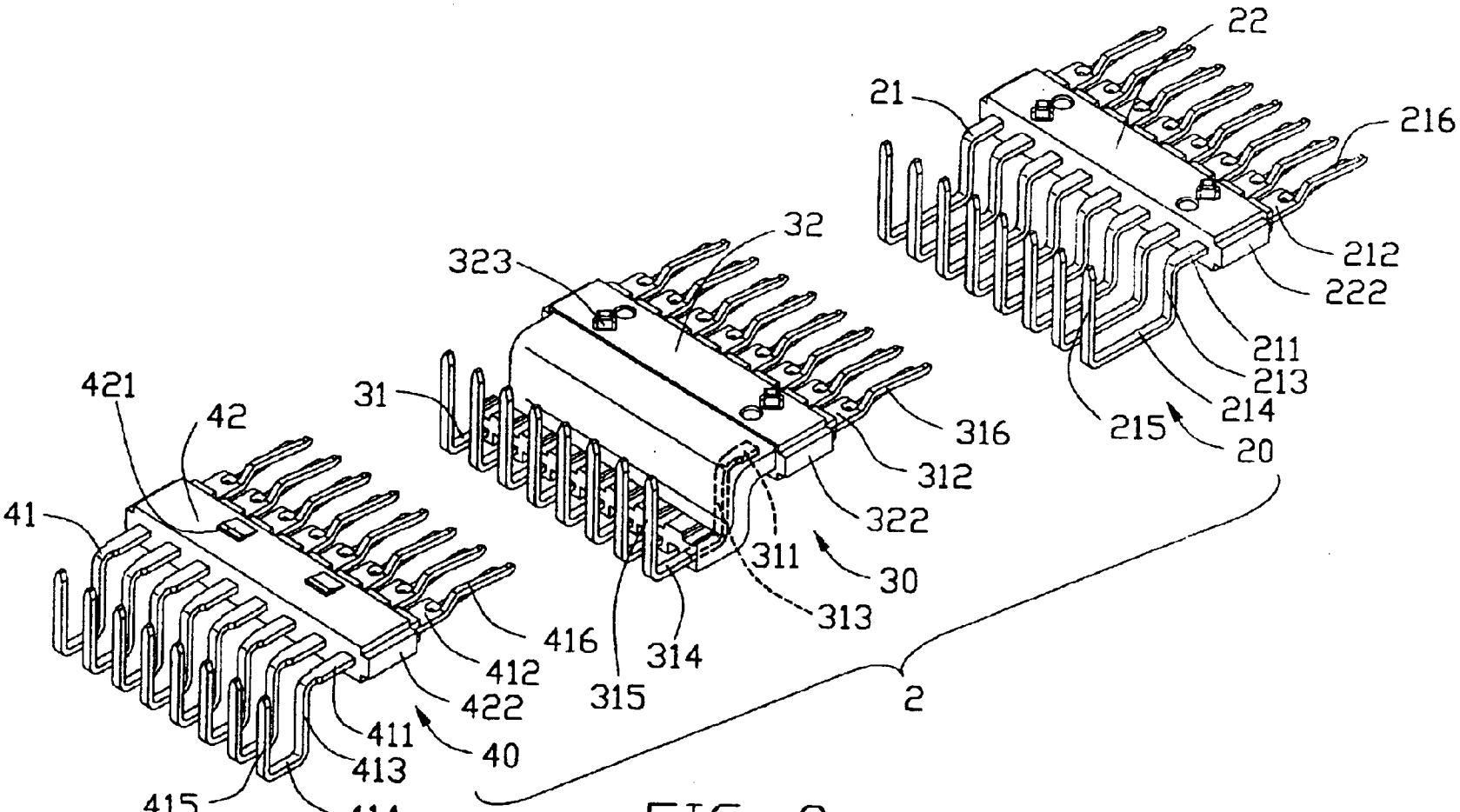
FIG. 3 is an enlarged view of a digital terminal module of the connector of FIG. 2.
Figure 4:
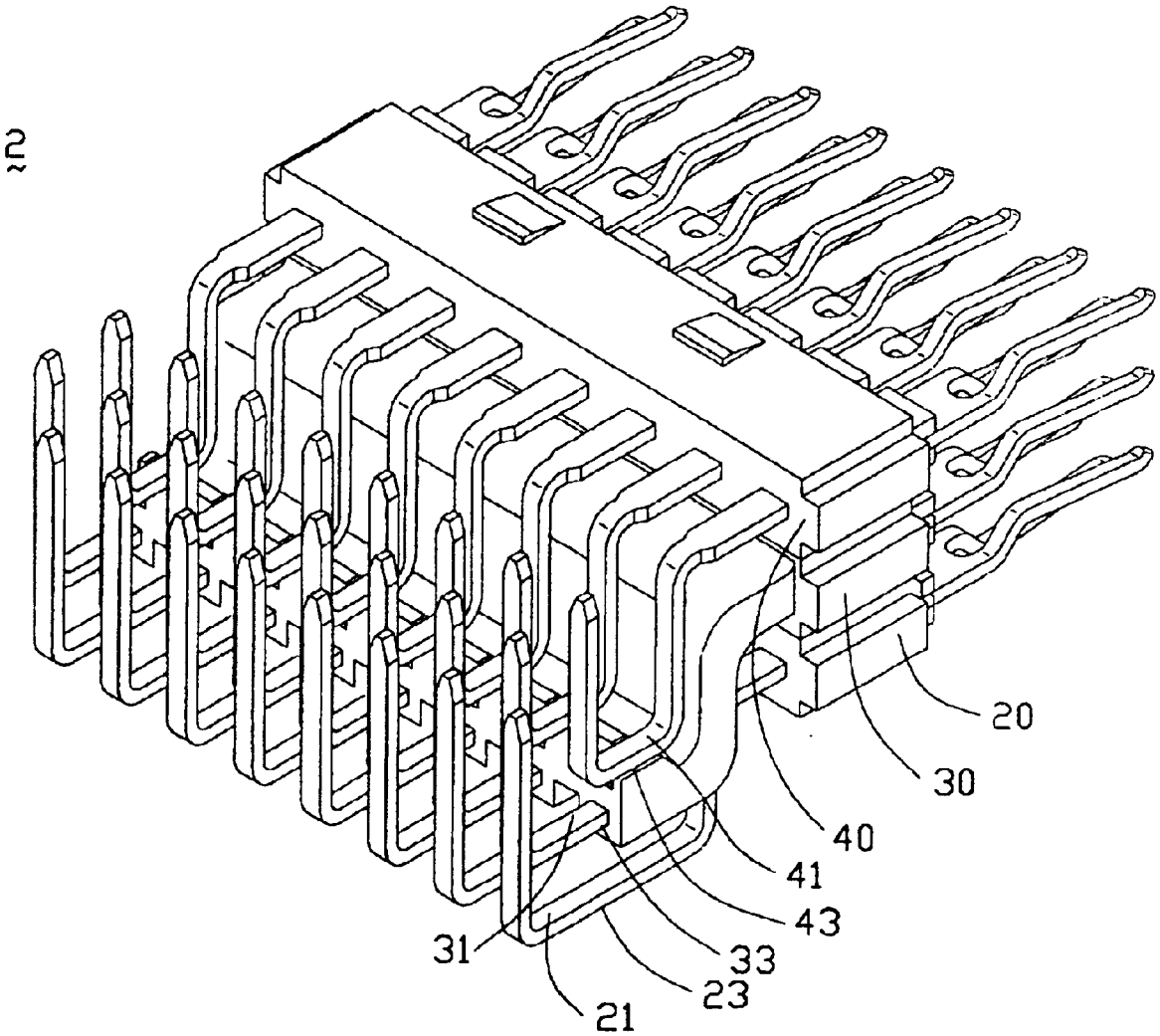
FIG. 4 is an assembled view of the digital terminal module of FIG. 3.

Referring to FIGS. 2 to 4, the digital terminal module 2 comprises three terminal inserts 20, 30, 40 which are stacked on and engaged with each other. Each terminal insert 20, 30, 40 comprises an insulation 22, 32, 42 and a plurality of terminals 21, 31, 41 arrayed at a horizontal line insert molded with the insulation 22, 32, 42. All of the terminals 21, 31, 41 have a similar structure, and are used for transmitting digital signal.

Each terminal 21, 31, 41 comprises an engaging portion 212, 312, 412 received in a corresponding passageway 16 for mating with a complementary connector and a leg portion (not labeled) connected with the engaging portion 212, 312, 412. Each engaging portion 212, 312, 412 comprises a fork-shaped mating portion 216, 316, 416. The leg portion comprises a middle portion 211, 311, 411 molded with the insulation 22, 32, 42 and connects with the engaging portion 212, 312, 412, an extending portion 213, 313, 413 connected to the middle portion 211, 311, 411 and extending therefrom vertically downwardly, a connecting portion 214, 314, 414 extending horizontally rearwards from a bottom of the extending portion 213, 313, 413 and a tail portion 215, 315, 415 extending vertically upwardly from a rear end of the connecting portion 214, 314, 414. The extending portion 213, 313, 413 connecting portion 214, 314, 414 and tail portion 215, 315, 415 together define a generally U-shaped structure. The insulation 42 of the terminal insert 40 has two ramps 421 formed on a top face thereof and holes and projections (not shown) on a bottom face thereof. The insulation 32 of the terminal insert 30 has projections 323 and holes (not shown) formed on a top face and a bottom face thereof. An S-shaped partition 34 extends rearwardly and downwardly from the insulation 32 and encloses the middle portions 311 and the extending portions 313 of the terminals 31. The insulation 22 of the terminal insert 20 has projections and holes (not labeled) on a top face thereof and ramps (not shown) on a bottom face thereof. In assembly, the terminal inserts 20, 30, 40 are stacked on and engaged with each other with the projections fitted into corresponding holes to form the digital terminal module 2. The insulative portions 22, 32, 42 each form a pair of projections 222, 322, 422 at lateral ends thereof which is used for engaging with corresponding grooves 152 defined by the base portion 11 of the insulative housing 10 when the digital terminal module 2 is assembled to the insulative housing 1. The ramps 421 of the terminal insert 40 and the ramps of the terminal insert 20 are for fitting into the recesses 151 of the base portion 11 of the housing 10. When the digital terminal module 2 is received in the housing 10, the connecting portion 214 is fitted in the groove 148.

Figure 6:
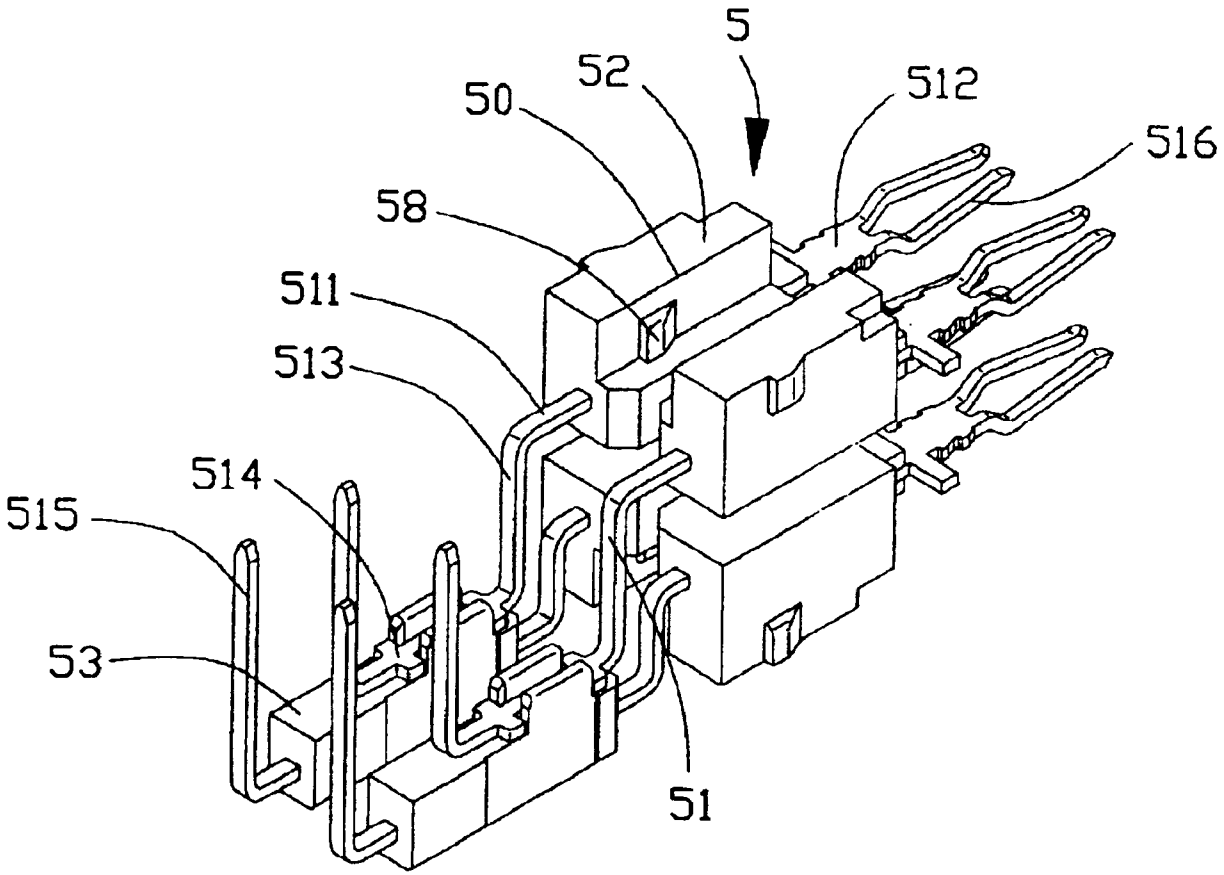
FIG. 6 is an enlarged view of an analogue terminal module of the connector of FIG. 2.

Referring to FIGS. 2, 3 and 6, the analog terminal module 5 comprises two terminal inserts 50. Each of the terminal inserts 50 comprises front and rear dielectric portions 52, 53 and two terminals 51. The terminals 51 have a similar configuration with the terminals 21, 31, 41, but are used for transmitting analogous signal. The dielectric portion 52 includes protrusions 58 on lateral sides thereof The dielectric portions 53 are integrally molded with connecting portions 514 of the terminals 51 and are to be fitted in the grooves 149 of the tongue portion 131 of the rear portion 13. The analogue terminal module 5 and the insulative housing 10 are assembled together by inserting the dielectric portions 52 into the receiving space 17 of the insulative housing 10 with the blocks 58 engaging with the base portion 11. The terminals 51 each also have an engaging portion 512 with a fork-shaped mating portion 516 for engaging with a contact of the complementary connector. A middle portion 511 extends rearwards from a corresponding engaging portion 512. An extending portion 513 extends vertically downwardly from the middle portion 511, and a tail portion 515 extends vertically upwardly from the connecting portion 514.

Referring to FIG. 2, a metal grounding plate 54 is installed between the terminal inserts 50. The grounding plate 54 includes a mating portion 55 received in a vertical passageway of the cross silts 18 for mating with a contact of the complementary connector, and a soldering portion 56 for soldering on the printed circuit board.

Referring to FIGS. 1 and 2, the spacer 60 defines a plurality of holes 61 corresponding to the tail portions 215, 315, 415, 515 of the terminals 21, 31, 41, 51 and the soldering portion 56 of the grounding plate 54. A pair of projections 62 is formed on lateral sides of the spacer 60 for being received into the recesses 145 of the arms 14 when the spacer 60 is assembled to the insulative housing 10. The tail portions 215, 315, 415, 515 and soldering portion 56 extend through corresponding holes 61 of the spacer 60 when the terminal modules 2, 5 and the spacer 60 are assembled to the housing 10 so that the tail portions 215, 315, 415, 515 and the soldering portion 56 can be suitably positioned. The projections 62 are retained into the recesses 145 of the arms 14. Therefore, the spacer 60 is received in the rear portion 13 of the insulative housing 10. The two nuts 90 of the DVI connector 1 in accordance with the present invention are to be received in the holes 112 of the base portion 11 of the housing 10, respectively. There is a screw hole (not labeled) defined in each of the nuts 90 for engaging with a screw of the complementary connector when the DVI connector 1 mates with the complementary connector.

Referring to FIGS. 1, 2 and 5, the grounding shield 7 includes a plate 71 and a shroud 77. The shroud 77 extends forwardly from the plate 71 for surrounding the mating portion 12 of the insulative housing 10. The plate 71 forms a pair of flanges 76 extending rearwards from top and bottom edges thereof, respectively, and a pair of claws 75 at each of opposite lateral ends thereof. A pair of positioning holes 74 is defined in the lateral ends of the plate 71 corresponding to the holes 112 of the base portion 11 and the screw holes (not labeled) of the nuts 90. The plate 71 further integrally forms a pair of flaps 72 located outside the positioning holes 74, respectively. The flaps 72 are for enclosing the steps 110 of the base portion 11. A pair of fingers 73 projects upwardly from the flaps 72 for soldering to the printed circuit board.

Each soldering tab 80 has a body portion 81. The body portion 81 forms a pair of fingers 85 extending upwardly for soldering to the printed circuit board. A retention portion 84 extends forwardly from a front end of the body portion 81 for fitting into the channel 113 when the soldering tab 80 is assembled to the housing 10. The retention portion 84 forms serrations (not shown) on its top and bottom edges for biting into the housing 10 to thereby securely fasten the soldering tab 80 to the housing 10. A pair of upper and lower securing portions 83 extends laterally outwardly from a front end of the body portion 81. A bending portion 82 extends forwardly from a rear end of the body portion 81 and inserts into the slot 146 of a corresponding arm 14. The securing portions 83 are vertically mirror-imaged, and each generally has an L-shaped configuration and is reliably received in a corresponding depressed portion 114 of the body portion 11. After the grounding shield 7 and the soldering tabs 80 are assembled to the housing 10, the claws 75 engage rear faces of the securing portions 83 (FIG. 1) so that the shield 7 and the soldering tabs 80 are electrically connected together.

By the U-shaped design cooperatively formed by the extending portion 213 (313, 413, 513), the connecting portion 214 (314, 414, 514) and the tail portion 215 (315, 415, 515) of the terminals 21 (31, 41, 51), the terminals 21 (31, 41, 51) are long enough to obtain the required impedance in accordance with the interconnecting system and can have a lowered profile to reduce the overall profile of the connector 1.

When mounted to an edge of the PCB, the top surfaces 143 of the arms 14 and the upper surfaces 111 of the steps 110 abut against a bottom face of the PCB with the fingers 73, 85 fitted into the PCB and soldered thereto and the posts 147 fitted into the PCB, whereby the connector 1 is firmly and stably mounted to the edge of the PCB. Furthermore, when the connector 1 is mounted to the PCB, the connector 1 generally has a half height above the PCB and a half height below the PCB; the connector 1 thus has a reduced profile above/below the PCB to meet a thin trend of an electronic device (i.e., the LCD monitor) accommodating the DVI connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted on a printed circuit board (PCB), comprising:

an insulative housing having a base portion, a mating portion extending forwardly from a front face of the base portion, a mounting portion extending rearwardly from a rear face of the base portion, a plurality of passageways defined in the mating portion, a pair of steps formed at opposite lateral ends of the base portion, a pair of arms formed at lateral ends of the mounting portion, a space defined between the rear face of the base portion and an upper face of the mounting portion for receiving the PCB therein;

a grounding shield having a plate, a shroud extending from the plate for surrounding the mating portion; and a terminal module having an insulation mounted to the base portion of the housing and a plurality of terminals molding with the insulation;

wherein top surfaces of the arms and upper surfaces of the steps for abutting a surface of the PCB are located at a same level and being located below a top surface of the base portion and a top surface of the mating portion;

wherein each terminal has a middle portion molded with the insulation, a mating portion extending forwardly from the middle portion into a corresponding passageway, a leg portion extending rearwardly from the middle portion includes a U-shaped configuration with a free end upwardly extending through the PCB;

wherein a S-shaped partition extends rearwarldy and downwardly from the insulation and encloses the middle portions and connecting portions of the terminals.

2. The connector as claimed in claim 1, wherein the grounding shield further comprises a pair of flaps enclosing the steps of the base portion, a pair of fingers projects upwardly form the flaps for soldering on the PCB.

3. The connector as claimed in claim 1 further comprising a pair of soldering tabs each comprising at least a finger portion for soldering to the PCB, a pair of securing portions fitted in depressed portions of the base portion of the housing, and a retention portion securely fitted into the base portion of the housing.

4. The connector as claimed in claim 1, wherein a first receiving space is defined in the base portion and receives the insulation of the terminal module therein.

5. The connector as claimed in claim 1, wherein a second receiving device is defined in the base portion beside the first receiving space.

6. The connector as claimed in claim 1, wherein the base portion defines a pair of through holes corresponding positioning holes defined by the grounding shield and a pair of depressed portions above and below a corresponding through hole.

7. The connector as claimed in claim 1, wherein the base portion of the housing has an intermediate wall defining a plurality of grooves facing the first receiving space and receiving a lateral edge of the terminal module.

8. The connector as claimed in claim 4, wherein a spacer is mounted between the arms and having a plurality of through holes therein, the legs of the terminals having tail portions extending through the through holes.

9. The connector as claimed in claim 4, wherein the leg portion has an extending portion extending downwardly from the middle portion, a connecting portion extending rearwardly from the extending portion, and a tail portion extending upwardly from the connecting portion adapted to be soldered to the PCB.

10. The connector as claimed in claim 4, wherein the mating portion of terminal has a fork shape.

11. The connector as claimed in claim 8, wherein the terminals of the terminal module are used for transmitting digital signal and the connector further comprises a second terminal module received into the second receiving space, the second terminal module having terminals for transmitting analogous signal.

12. The connector as claimed in claim 10, wherein a plurality of barbs is formed on a pair of sides of the connecting portion, a plurality of blocks is formed on the tongue portion, the barbs engaging the blocks.

13. The connector as claimed in claim 6, wherein a pair of nuts fitted in the through holes of the base portion adapted for threadedly engaging with screws of a complementary connector.

* * * * *